US010550588B2

(12) United States Patent
Smith et al.

(10) Patent No.: US 10,550,588 B2
(45) Date of Patent: Feb. 4, 2020

(54) PEAKED ROOFING PALLETS

(71) Applicants: Daniel W. Smith, Carmel, IN (US); Jeffrey Neagli, Indianapolis, IN (US)

(72) Inventors: Daniel W. Smith, Carmel, IN (US); Jeffrey Neagli, Indianapolis, IN (US)

( * ) Notice: Subject to any disclaimer, the term of this patent is extended or adjusted under 35 U.S.C. 154(b) by 0 days.

(21) Appl. No.: 15/873,485

(22) Filed: Jan. 17, 2018

(65) Prior Publication Data

US 2019/0218799 A1 Jul. 18, 2019

(51) Int. Cl.
*E04G 3/26* (2006.01)

(52) U.S. Cl.
CPC ..... *E04G 3/26* (2013.01)

(58) Field of Classification Search
CPC .. E04G 3/26; E04G 3/265; E04G 3/00; E04G 1/36; E04G 21/14; E04D 15/00; E04D 15/003; B65D 19/08; B65D 19/18; B65D 25/24
USPC ..... 108/57.25, 57.28, 42; 182/45; 248/237; 414/10; 220/628
See application file for complete search history.

(56) References Cited

U.S. PATENT DOCUMENTS 403,636 A * 5/1889 Bitterly ..... E06C 1/397 182/20
472,867 A * 4/1892 Farland ..... E04G 3/26 248/237
673,065 A * 4/1901 Scott ..... E06C 1/397 182/155
674,170 A * 5/1901 Kuhn ..... E04G 3/26 248/237
829,312 A * 8/1906 Alberty ..... E04G 3/26 248/237
956,406 A * 4/1910 Nowodworski ..... E04G 3/26 182/45
980,618 A * 1/1911 Douglas ..... E04G 3/26 182/45
988,808 A * 4/1911 Parris ..... E04G 3/265 182/45
1,148,919 A * 8/1915 Nielsen ..... E04G 3/26 248/237
1,222,053 A * 4/1917 Watson ..... E04G 3/26 182/45
1,248,228 A * 11/1917 West ..... E06C 1/397 182/108
1,365,996 A * 1/1921 Herwick ..... E04G 3/265 182/45

(Continued)

FOREIGN PATENT DOCUMENTS

| | | |
|---|---|---|
| DE | 3632735 | 3/1988 |
| GB | 2365845 | 2/2002 |
| WO | WO 98/17541 | 4/1998 |

OTHER PUBLICATIONS

International Search Report from corresponding PCT application No. PCT/US2019/013668 dated May 10, 2019 (11 pages).

*Primary Examiner* — Colleen M Chavchavadze
*Assistant Examiner* — Shiref M Mekhaeil
(74) *Attorney, Agent, or Firm* — Brinks Gilson & Lione

(57) ABSTRACT

A pallet that is configured and designed to support a load of material and rest alternatively on a flat surface on a roof so as to straddle the peak of ridge of a roof. The pallets can be loaded with materials such as roofing shingles, delivered to a work site on a truck bed and lifted up an positioned on the peak or ridge of a roof without having to unload the materials from the pallets.

10 Claims, 3 Drawing Sheets

(56) References Cited

U.S. PATENT DOCUMENTS 1,770,097 A * 7/1930 Bede ..... E04G 3/265 248/237
2,448,746 A * 9/1948 Sundeen ..... E04G 3/265 182/45
3,058,542 A * 10/1962 Rogalla ..... E04G 3/26 182/45
3,318,473 A * 5/1967 Jones ..... B65D 88/26 108/55.1
4,326,467 A 4/1982 Schleicher et al.
D307,969 S * 5/1990 Box ..... D3/312
5,304,095 A * 4/1994 Morris ..... F24F 7/02 454/365
5,331,783 A 7/1994 Kasner et al.
5,377,600 A * 1/1995 Speese ..... B65D 19/0016 108/51.3
5,623,788 A * 4/1997 Bimberg ..... E04B 7/02 52/23
5,960,904 A * 10/1999 Ullmann ..... E04G 3/26 182/45
6,269,905 B1 * 8/2001 Smith ..... E04D 15/02 182/45
6,745,869 B2 * 6/2004 Garrett ..... B23D 45/003 182/45
7,874,451 B2 * 1/2011 Bel ..... E04D 15/00 220/628
8,016,079 B1 * 9/2011 Huls ..... B27B 21/00 182/152
2005/0207873 A1 * 9/2005 Endrud ..... E04D 15/02 414/10
2008/0245280 A1 * 10/2008 Wainland ..... A47B 13/003 108/153.1
2009/0044732 A1 2/2009 Mackenzie
2009/0229213 A1 * 9/2009 Mistelski ..... A01M 31/02 52/650.3
2009/0249740 A1 * 10/2009 Crookston ..... E04D 15/02 52/749.12
2010/0213005 A1 * 8/2010 Sistonen ..... E04D 15/02 182/45
2011/0283923 A1 11/2011 Potter
2013/0220403 A1 * 8/2013 Rizzo ..... F16B 7/0446 136/251
2015/0021452 A1 * 1/2015 Bourbonnais ..... B65D 19/38 248/544
2017/0274232 A1 * 9/2017 Kreuser ..... A62C 3/0257
2018/0334814 A1 * 11/2018 Rashid ..... E04G 3/26
2019/0062124 A1 * 2/2019 Sedlock ..... B66C 1/38

* cited by examiner

PEAKED ROOFING PALLETS

BACKGROUND

The present invention relates generally to roof construction and replacement and more particularly to specialized pallets for transporting and delivering roofing materials, including roofing shingles onto peaked roofs.

Roofing shingles are generally packaged in bundles that are stored and shipped on wooden pallets. Prior to the construction of new roofs or the replacement or reroofing of existing roofs roofing shingles need to be delivered onto the roofs. Pallets loaded with bundles of roofing shingles are transported by trucks from warehouses to the worksites and the individual shingle bundles are hauled up to the roofs by a conveyor or the pallets loaded with the shingle bundles are lifted up by a crane or fork lift. In the case of lifting pallets up to a roof by a crane or fork lift the individual bundles of shingles are unloaded from the pallets manually by workers and stacked on opposite sides of the roof ridge. The process of delivering shingles onto roofs is time consuming, labor intensive and exposes workers to unnecessary hazards.

U.S. Pat. No. 6,745,869 to Garrett, U.S. Patent Application Publication No. 2005/0207873 to Endrud, U.S. Patent Application Publication No. 20150021452 to Bourbonnais, United Kingdom Patent Application No. 2 365 845 to Wigley and German Patent Application No. DE3632735 to Bruenyjen exemplify various structures for supporting materials on roofs which involve complicated adjustable structures that require assembly and adjustment which can be inconvenient and hazardous for workers on roofs. In some cases these prior art devices merely provide platforms which can receive various objects including pallets.

U.S. Pat. No. 7,874,451 to Bel discloses a container for use on planar surfaces having various slopes. U.S. Patent Application Publication No. 2009/0044732 to MacKenzie discloses a pallet with a collapsible frame. U.S. Pat. No. 4,326,467 to Schleicher et al. discloses a pallet formed from a folded profiled metal sheet.

The present invention provides pallets that are designed and configured to straddle and rest on the ridge or peak of a roof which pallets can be used to store, transport and deliver roofing materials, including shingles onto roofs during construction or reroofing.

BRIEF SUMMARY

According to various features, characteristics and embodiments of the present invention which will become apparent as the description thereof proceeds, the present invention provides a pallet having a length and a width that is configured to rest alternatively on the peak of a roof and on a flat surface, the pallet comprising:

- a top deck for receiving and supporting materials to be delivered to a rooftop;
- a base beneath the top deck; and
- a plurality of legs extending downward from the base,
- wherein the legs have: angled bottom portions for that are angled so as to rest on opposite sides of the peak of a roof; and flat bottom portions for resting the pallet on a flat surface.

The present invention further provides a method of delivering objects onto the roof of a building which method comprises:

- providing a pallet that comprises:
  - a top deck for receiving and supporting materials to be delivered to a rooftop;
  - a base beneath the top deck; and
  - a plurality of legs extending downward from the base, wherein the legs have: angled bottom portions for that are angled so as to rest on opposite sides of the peak of a roof; and flat bottom portions for resting the pallet on a flat surface;
- providing a load of objects on the pallet;
- lifting the pallet and positioning the pallet onto a roof of a building so that the pallet rests over a peak of the roof to deliver the objects onto the roof.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

The present invention provides pallets that are configured to receive materials, including roofing shingles, and support the materials on a flat surface or over the peak or ridge of a roof without the need for a separate conventional pallet. The pallets of the present invention are configured to be transported fully loaded on trucks to work sites and be lifted fully loaded and placed onto the peak of ridge of a roof using fork lifts, cranes, etc. without any necessary adjustments required to rest on the peak of a roof. The pallets are designed and configured to straddle the ridge or peak of a roof.

The pallets of the present invention can be manufactured as one-piece, molded structures that can be discarded after use or reused. In some embodiments that pallets can be molded from recyclable materials such as plastic materials for purposes of recycling of the materials. In other embodiments the pallets can be molded from materials such as particle board so that they can be discarded and burnt for disposal after use.

As described below the pallets of the present invention can be configured to be used in conjunction with roofs having different pitches. Further the pallets can be provided with structural elements to receive the forks of fork lifts, lifting straps, chains, etc. for purposes of lifting the pallets with a fork lift, a crane, a pulley system, etc.

The pallets of the present invention can be sized to support and deliver a typical amount of 42 bundles of shingles in which there are 3 bundles per square (100 square feet). The pallets can otherwise be sized to support and deliver a larger or smaller amount of shingles.

Figure 1:
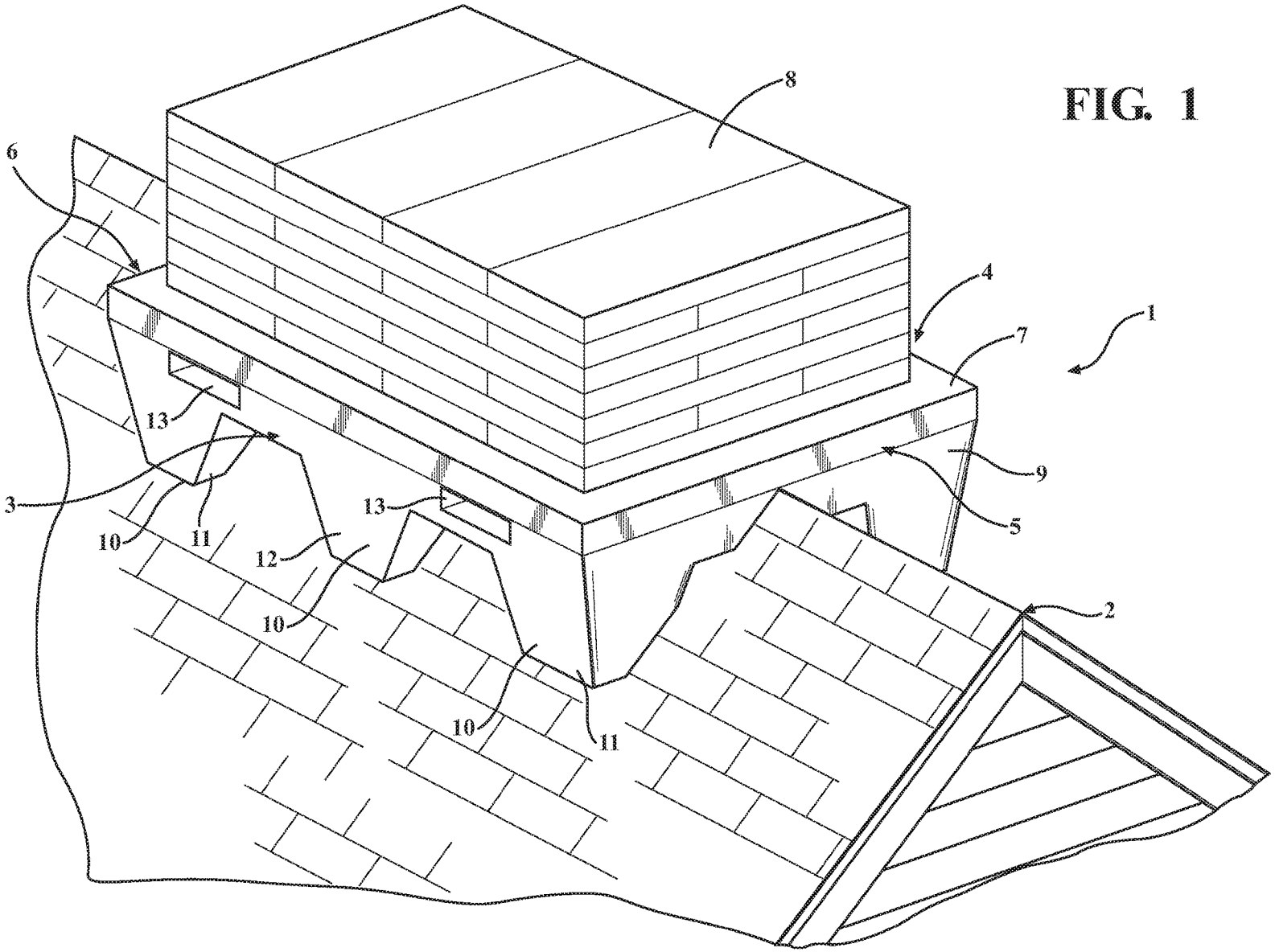
FIG. 1 a perspective view of a pallet according to the present invention positioned on the peak or a roof.

FIG. 1 a perspective view of a pallet according to the present invention positioned on the peak or a roof. In FIG. 1 pallet 1 is shown as straddling the peak or ridge of a roof 2 with opposite sides of the present resting on opposite sides of the roof. For purposes of describing the present invention reference numerals 3 and 4 will be used to identify the sides of the pallet 1 and reference numeral 5 and 6 will be used to identify the ends of the pallet 1. As shown the pallet 1 has a top surface or deck 7 that has a generally rectangular shape. FIG. 1 depicts a load of material, which can represent bundles of shingles 8 on the pallet 1. The deck 7 is supported by a base 9. The base 9 includes a number of legs 10 that extend downward upon which legs 10 the pallet 1 can be supported on a roof 2 as shown in FIG. 1 or on any flat surface such as a truck bed or storage area. The pallet 1 shown in FIG. 1 includes six legs 10, including four corner legs 11 and two middle legs 12 on each side. In other embodiments the pallets of the present invention can have only corner legs, or more than one middle leg on each side. In further embodiments the pallet can include a single leg on either side that extends along the entire length of or a substantial portion of the length of the pallet.

Above the legs 10 the pallet 1 can be provided with structural features that can be used to lift and move the pallet 1. For example the embodiment of the pallet 1 shown in FIG. 1 there are slots 13 provided in the base 9 beneath the deck 7 that can be configured to receive the forks of a fork lift. In other embodiments different structures can be included for receiving lifting straps, hooks, chains, etc., including slots, eye bolts, hooks, pins, etc.

Figure 2:
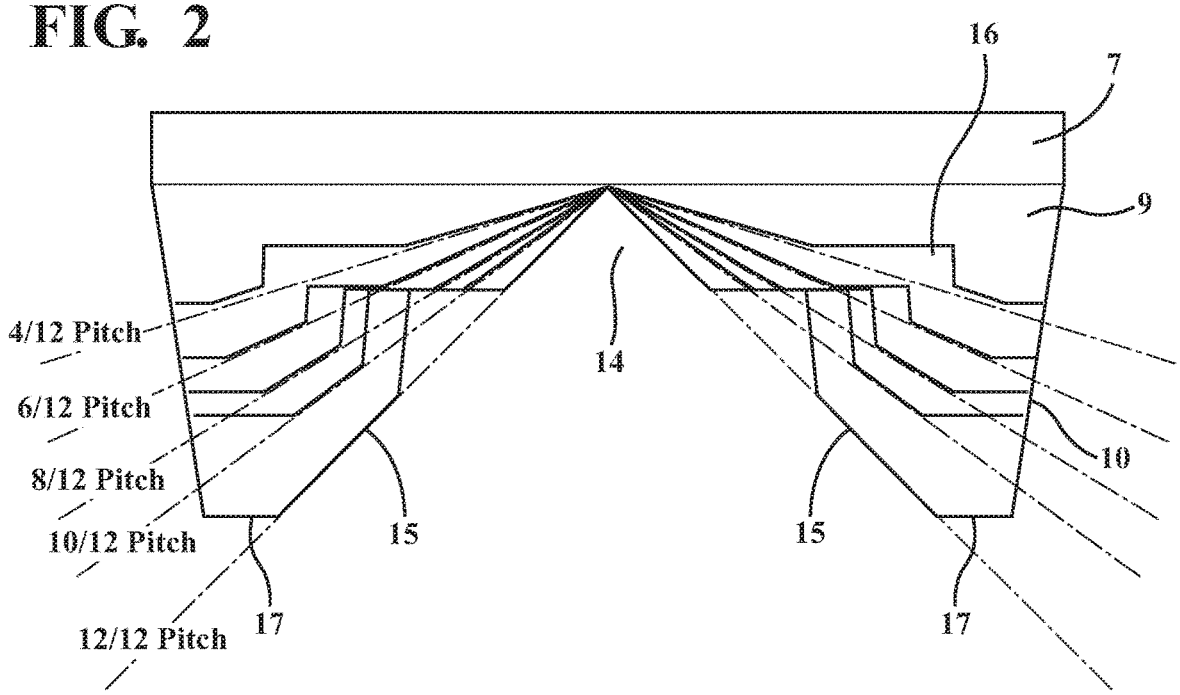
FIG. 2 is an end view that depicts alternative configurations of a pallet according to the present invention for different roof pitches.
Figure 3:
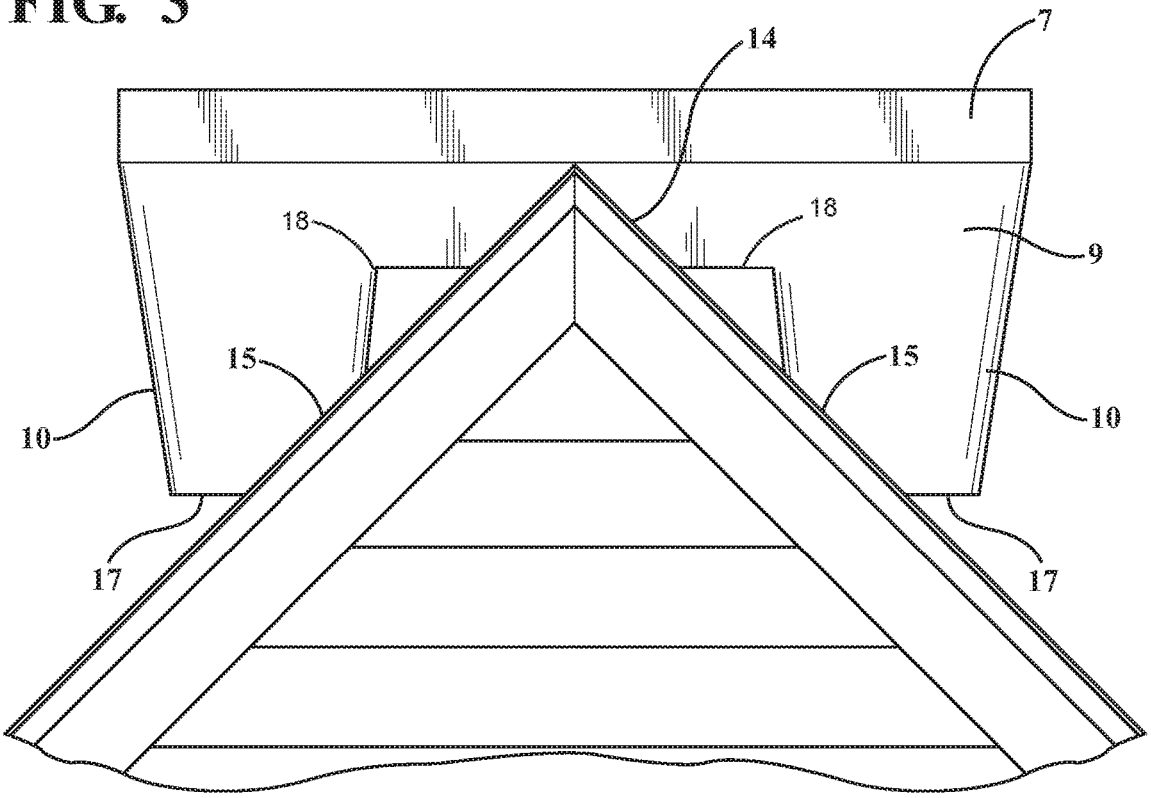
FIG. 3 is an end view of an end view of a pallet according to the present invention positioned on the peak of a roof.

FIG. 2 is an end view that depicts alternative configurations of a pallet according to the present invention for different roof pitches. Roofs have different pitches based on factors that include geographical location, the type of roofing material used, walkability and aesthetics. The pallets of the present invention are configured to be used in conjunction with roofs having different pitches. As shown in FIG. 2 the bottom of the pallets 1 are configured to be complementary to the peak or ridge of roofs to be received thereon. In this regard the center of the bottom of the pallet 1 has an inverted V-shaped recess 14 formed in the base 9 as viewed from either end of the pallet which V-shaped recess 14 extends across the length of the pallet 1. In addition the inner side of each of the legs 10 has an angled surface 15 at the bottom that extends upward toward the center of the bottom of the pallet 1. As shown in FIG. 1 the angle of the angled surfaces 15 of the legs 10 are linearly aligned with the sides of the V-shaped recess 14 for the different roof pitches that are drawn in broken lines in FIG. 2. As shown in FIGS. 2 and 3 the bottom of the pallet 1 can have a recessed area 16 in which the inverted V-shaped recess 14 is formed.

It is also seen in FIG. 2 that the height of the legs 10 vary for roofs having different pitches with shorter legs being provided on pallets that are configured to be used with roofs having smaller pitches. Also as shown in FIG. 2 the width of the recessed area 16 measured between the inside surfaces of the legs 10 in the width direction of the pallets increases as the roof pitch decreases.

Further it is noted that the bottoms of the legs 10 have flat surfaces 17 outward from the angled surfaces 15 which allow the pallets to rest on a flat surface for storage and transportation purposes.

FIG. 3 is an end view of an end view of a pallet according to the present invention positioned on the peak of a roof. As shown in FIG. 3 when the pallets 1 of the present invention are positioned on a roof 2 the peak or ridge of the roof is received in the invented V-shaped recess 14 in the bottom of the pallets 1 and the angled surfaces 15 of the legs 10 rest flatly against the angled sloped surface of the roofs. In this manner the weight of the pallets is distributed between the legs 10 and the bottom center of the pallets and the invented V-shaped recess 14 aligns/centers the position of the pallets and prevents the pallets from shifting sideways. Also shown in FIG. 3 are indentations 18. As shown the angled bottom surfaces 15 of the legs 10 are spaced from the V-shaped recess 14 by the indentations 18.

Figure 4:
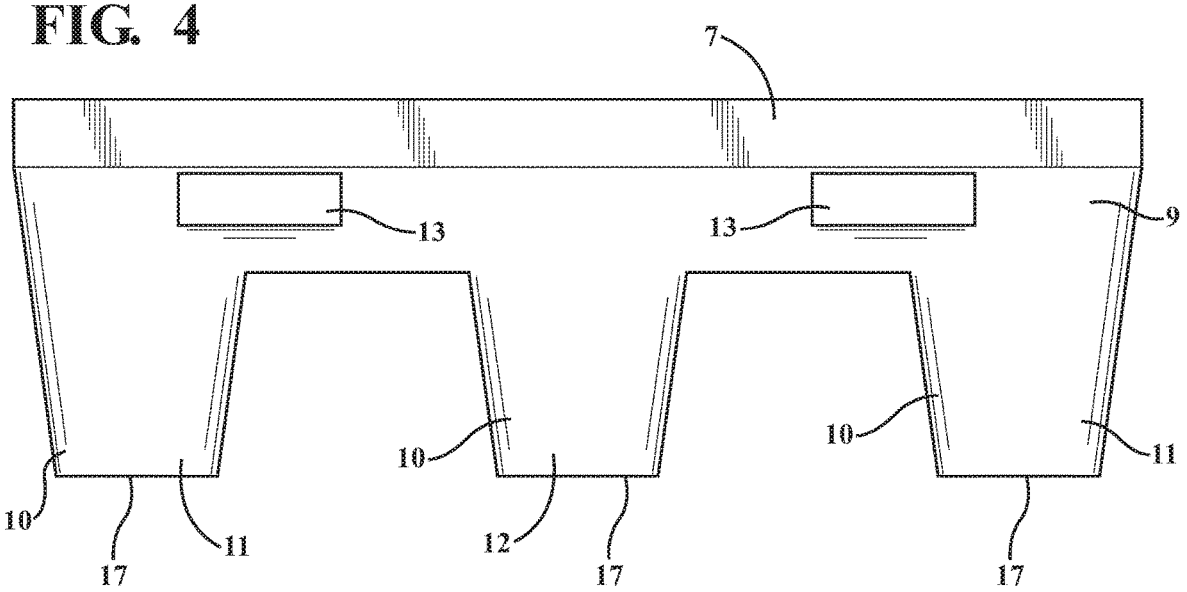
FIG. 4 is a side view of the pallet of FIG. 3.

FIG. 4 is a side view of the pallet of FIG. 3. The pallet 1 shown in FIG. 4 includes corner legs 11 and one middle leg 12. As shown the legs 11 and 12 can be tapered as viewed from the sides of the pallet 1 to reduce the amount of material (and weight) used to make the pallets. Alternatively the legs 11 and 12 could have straight, parallel sides if desired. The legs 11 and 12 can be similarly tapered as viewed from the ends (See FIG. 3) or have straight, parallel sides.

Figure 5:
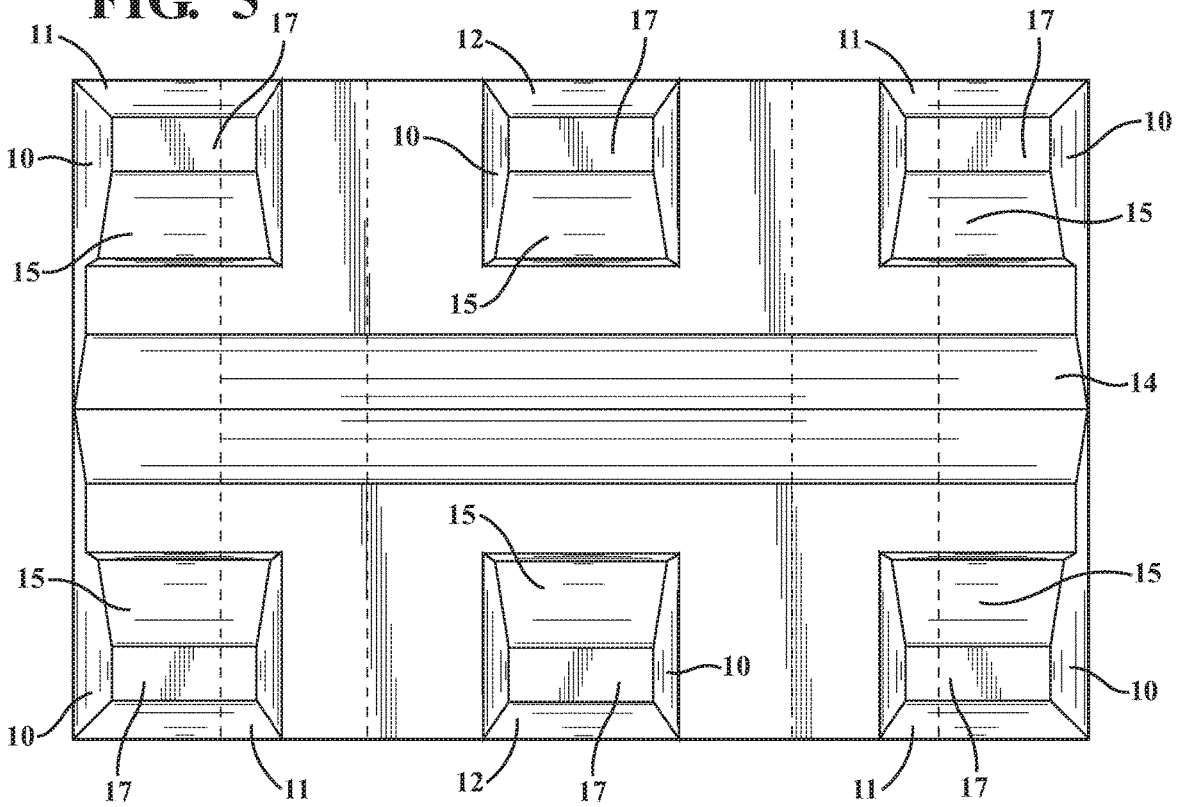
FIG. 5 is a bottom view of the pallet of FIG. 3.

FIG. 5 is a bottom view of the pallet of FIG. 3. In FIG. 5 the V-shaped recess 14 is shown as extending across the length of the pallet 1. The legs 10 are shown as having flat bottoms 17, angled sides 15 and tapered sides as discussed above. The slots 13 that are provided to receive the forks of a fork life are drawn in broken lines in FIG. 5 since these slots are hidden within the pallet 1. As drawn in FIG. 5 the slots 13 extend through the width of the pallet 1. For embodiments of the present invention in which slots 13 are provided that extend completely through the width of the pallet 1 the height of the pallet above the inverted V-shaped recess 14 and below the deck 7 or top surface of the deck 7 can be increased to accommodate the slots 13 so that they can pass over the peak or ridge of the roof when the pallet is positioned on a roof as shown in FIG. 3. Since the use of a fork lift may only be necessary to move the pallets for storage or loading on and off a truck having the forks of a fork life pass through the inverted V-shaped recess 14 will not cause any problems. When such a pallet is lifted by a crane to be position onto a roof in manner that does not obstruct the inverted V-shaped recess having the slots aligned as shown in FIGS. 1 and 4 will not cause any problems.

As shown in FIG. 5 the legs 11 and 12 of the pallet 1 are located within the sides 3, 4 and ends 5, 6 of the deck 7. This configuration will allow empty pallets to be stacked upon one another.

The pallets shown in FIGS. 1-5 have lengths that are greater than the widths of the pallets. In other embodiments the pallets can be configured to have widths that are greater that the lengths of the pallets which might be preferred depending in the space available on a roof.

As mentioned above the pallets can be manufactured as one-piece, molded structures that can be discarded after use or reused. In some embodiments that pallets can be molded from recyclable materials such as plastic materials for purposes of recycling of the materials. In other embodiments the pallets can be molded from materials such as particle board so that they can be discarded and burnt for disposal after use. The use of disposable pallets can eliminated the need of carefully removing the pallets from a roof using a crane or other lifting equipment. Disposable pallets can merely be dropped off a roof without any disassembly and collected with other discarded materials for disposal.

An alternative to a single-piece molded pallet is a pallet that is fabricated from several parts for use as a unitary structure. As an example a unitary pallet could be constructed from a number of wooden parts for use as a unitary structure.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. A pallet having a length and a width that is configured to rest on a peak of a roof and on a flat surface, the pallet comprising:

a top deck for receiving and supporting materials to be delivered to a rooftop;

a base beneath the top deck;

a plurality of legs extending downward from the base;

a recessed area formed in the bottom of the base; and an inverted V-shaped channel centered in the recessed area formed in the bottom of the base, and indentations on both sides of said V-shaped channel;

wherein the plurality of legs have: angled bottom portions that are angled so as to rest on opposite sides of the peak of the roof; and flat bottom portions for resting the pallet on a flat surface, the angled bottom portions of the plurality of legs being in coplanar alignment with sides of the V-shaped channel said angled bottom portions spaced from said V-shaped channel by said indentations.

2. The pallet according to claim 1, wherein the inverted V-shaped channel extends in the direction of the length and is configured to rest on the peak of a roof.

3. The pallet according to claim 2, wherein the angled bottom portions of the plurality of legs and the inverted V-shaped channel are configured to allow the pallet to rest substantially flat on a roof having a predetermined pitch.

4. The pallet according to claim 1, wherein the plurality of legs include a corner leg located in each corner of the pallet.

5. The pallet according to claim 4, wherein the plurality of legs include legs located between the corner legs at least along the length of the pallet.

6. The pallet according to claim 1, wherein the pallet is a one-piece molded structure.

7. The pallet according to claim 1, wherein the pallet is a unitary structure.

8. The pallet according to claim 1 further comprising structural elements for lifting the pallet.

9. The pallet according to claim 8, wherein the structural elements for lifting the pallet comprises slots for receiving forks of a fork lift.

10. The pallet according to claim 1, wherein the plurality of legs are tapered.

* * * * *